US007278588B2

(12) United States Patent
English et al.

(10) Patent No.: US 7,278,588 B2
(45) Date of Patent: Oct. 9, 2007

(54) ELASTOMERIC RAILWAY TIE PAD

(75) Inventors: Tom English, Portland, OR (US); Joe Lucas, Jr., Portland, OR (US); Dean Putnam, Salem, OR (US)

(73) Assignee: Northwest Rubber Extruders, Inc., Beaverton, OR (US)

( * ) Notice: Subject to any disclaimer, the term of this patent is extended or adjusted under 35 U.S.C. 154(b) by 138 days.

(21) Appl. No.: 10/984,588

(22) Filed: Nov. 8, 2004

(65) Prior Publication Data

US 2006/0097064 A1 May 11, 2006

(51) Int. Cl.
*E01B 19/00* (2006.01)

(52) U.S. Cl. ..... 238/382

(58) Field of Classification Search ..... 238/382, 238/283, 2, 8, 107, 108
See application file for complete search history.

(56) References Cited

U.S. PATENT DOCUMENTS

| | | | | |
|---|---|---|---|---|
| 2,291,611 | A | 8/1942 | Dooling | |
| 2,377,942 | A | 6/1945 | Johnson | |
| 2,770,421 | A | 11/1956 | Wilson | |
| 2,779,543 | A | 1/1957 | Grönlund | |
| 3,289,941 | A | 12/1966 | Sonneville | |
| 3,587,964 | A * | 6/1971 | Cork | 238/92 |
| 4,254,908 | A | 3/1981 | Matsubara | |
| 4,609,144 | A | 9/1986 | Harmsen | |
| 4,648,554 | A | 3/1987 | McQueen | |
| 4,771,944 | A * | 9/1988 | Brister et al. | 238/283 |
| 5,261,599 | A * | 11/1993 | Brown | 238/283 |
| 5,335,850 | A | 8/1994 | Igwemezie | |
| 5,826,791 | A | 10/1998 | Broughton | |
| 6,283,383 | B1 * | 9/2001 | Blank et al. | 238/382 |
| 6,386,461 | B1 * | 5/2002 | Wildgoose | 238/283 |
| 6,481,637 | B1 | 11/2002 | McQueen | |

FOREIGN PATENT DOCUMENTS

| | | |
|---|---|---|
| DE | 3935354 | 4/1991 |
| JP | 54153407 | 5/1978 |
| JP | 5171601 | 7/1993 |

OTHER PUBLICATIONS

Charity Sasaoka et al., "Evaluations of Track Damping Pads and Track Designs for Reducing Impacts at Special Trackwork", Technology Digest, Feb. 2004, pp. 1-4, Issue No. TD-04-002, Transportation Technology Center, Inc.
William W. Hay, "Track Analysis", Railroad Engineering, pp. 258-275, 2nd Ed., Wiley-Interscience publication, no date.

(Continued)

*Primary Examiner*—Mark T. Le
(74) *Attorney, Agent, or Firm*—Chernoff, Vilhauer, McClung & Stenzel, LLP

(57) ABSTRACT

An elastomeric member is arranged beneath a railroad tie to adjust the modulus of track over a relatively stiff structure such as a bridge or tunnel. Methods or combinations that include an elastomeric member are employed to reduce the modulus of a track over a relatively stiff structure to a magnitude approximating the modulus of track over the terrain surrounding the structure.

7 Claims, 6 Drawing Sheets

OTHER PUBLICATIONS

Satya P. Singh, et al., "Reducing Impact Forces on High-Angle Crossing Diamonds", Technology Digest, Aug. 1998, Issue No. 98-021, Transportation Technology Center, Inc.

DingQuing Li, et al., "Vertical Track Stiffness Tests of Revenue Service Bridges and Approaches", Technology Digest, Jun. 2003, pp. 1-4, Issue No. TD-03-013, Transportation Technology Center, Inc.

Unknown, "Rubber in Compression", pp. 69-84, no date.

Charity D. Sasasoka, et al., "Implementing Track Transisition Solutions", pp. 1-10, Transportation Technology Center, Inc, no date.

TTCI, "Workshop: Reduced Impact/Improved Performance Track", Sep. 19, 2004, pp. 1-1 thru 9-5, AAR Engineering Research Committee.

* cited by examiner

ELASTOMERIC RAILWAY TIE PAD

BACKGROUND OF THE INVENTION

The present invention pertains to an elastomeric tie pad for a railroad track.

When railcars travel over railroad track, they are often subjected to an undesirable amount of vibration and periodic impacts that tend to dislodge cargo, damage railroad ties and railcar structures, such as wheels, degrade railroad track, and/or annoy passengers. Accordingly, much effort has been expended to design railroad tracks in such a way that minimizes these vibrations and impacts.

Railroad track typically include two parallel metal rails mounted on a plurality of transverse railroad ties, typically made of plastic, concrete, wood, or a combination thereof. The ties, in turn, are usually supported by ballast that typically comprises rock or other similar material and is laid over subgrade or other type of underlayment. In the case of "open track", the subgrade is simply the ground, while in the case of track laid over a bridge, tunnel, or other structure, the subgrade may be concrete, wood, or other such material. In addition, it is often desirable to include an impermeable layer of subballast between the ballast and the subgrade, typically comprising compacted fine gravel.

Excessive rail car vibration can result from too little track deflection as a railcar moves over the track. Though metal rails and concrete ties will deflect somewhat under the weight of a passing rail car, the amount of deflection each contributes to the total track deflection needed for a smooth ride is relatively insignificant. Of the materials that comprise the railroad track (i.e., the rails, the ties, and the ballast), most of the deflection is provided by the ballast. Open ground can also contribute a relatively significant amount of deflection under the weight of a passing rail car. The amount of open ground deflection varies significantly depending upon the type of terrain.

The total deflection of track laid over open ground is usually sufficient to provide an adequately smooth ride. In instances where this is not the case, such as where the ground is particularly rocky, additional ballast may be provided, or wood ties may be used, which deflect more than concrete ties.

Railroad track must often be laid over structures such as tunnels, bridges, and the like that have significantly less deflection than open ground. Further, tunnels often have insufficient clearance to include an appropriate amount of ballast. Thus, a rail car that travels over or through such structures will be subjected to undesirable vibrations due to the loss of the deflection otherwise provided by the ballast and/or the open ground.

One prior art suggestion to reduce rail car vibrations in tunnels, or further reduce rail car vibrations over open ground, is to include soft elastomeric material beneath either the rails or the ties. For example, Sonneville, U.S. Pat. No. 3,289,941 suggests that a sheath of gas-injected elastomeric material beneath concrete ties in a tunnel can increase track deflection, even where the tunnel does not permit ballast.

One problem encountered with these solutions is that, even where the deflection of the track on a structure such as a tunnel or a bridge is sufficient to dampen vibrations, a rail car traveling over a bridge or tunnel may nonetheless receive a significant transition impact or shock. This transition impact results not from the steady vibrations caused by insufficient cushioning over the length of the bridge or tunnel, but instead from the boundary between the bridge, tunnel, or other structure and its adjacent approach. Further, the resulting transition impact may be transmitted along the length of a train when each rail car in the train passes over the boundary. An additional problem with existing solutions to reduce rail car vibrations in tunnels is that the soft material used for cushioning wears significantly after repeated deflections, either hardening to the point where vibration once again becomes problematical, or failing altogether.

What is desired, therefore, is an improved system for reducing vibrations and/or periodic impacts encountered as a railroad car travels over transitions between open track and structures such as bridges or tunnels.

DETAILED DESCRIPTION

In this specification, unless otherwise specifically noted, the term "railroad track" is intended to encompass a parallel set of rails—usually but not necessarily metal—along with the railroad ties, ballast, and any sub-ballast that support the rails. The term "modulus" or "elastomeric modulus" refers to the amount of linear pressure (i.e., pounds per inch of track) required to deflect a track by one inch. The unit associated with the "elastomeric modulus" is pounds/inch/inch. The term "underlayment" is intended to refer to the material over which ballast of a railroad track is laid where this material is open ground, the underlayment will be referred to as "subgrade." The term "approach" is intended to refer to the section of railroad track positioned adjacent a structure, such as a bridge or tunnel, and includes the sub-ballast over which the track is laid. The term "durometer" used in reference to a material refers to the Shore A hardness of that material.

As stated previously, an existing problem associated with railroad track laid over structures is the excessive vibrations and impacts that result from the loss of deflection of open ground. The existing solution of placing a soft elastomeric pad beneath the railroad track is frequently inadequate because the pad stiffens significantly over time, losing its ability to dampen vibrations. Furthermore, such a pad does not sufficiently reduce the transition impact that results from a rail car passing over the boundary where the track subgrade changes from deflectable open ground of the approach 20 to less deflectable underlayment of the structure 22.

Upon consideration of these problems, the present inventors first realized that, although counterintuitive, vibration dampening over a track laid on a manmade structure might better be achieved with hard, or stiff, elastomeric pad positioned beneath a railroad tie. The added deflection provided by such a pad could be primarily achieved, not by the relative softness of the material, but instead by the shape of the pad. Further, because the pad itself is hard, rather than soft, it will stiffen less over time and will be far more durable than a soft pad or other material used for a similar purpose.

The present inventors also realized that using an elastomeric pad, of any particular stiffness, to simply reduce vibration (achieve a track deflection that approximates that of open ground) will often not be sufficient to reduce the aforementioned transition impact. Instead, where it is desired to reduce the transition impact, the elastomeric pad, in combination with a railroad track over a structure, should achieve a track deflection that approximates the terrain of the particular approach to that structure. The use of a relatively stiff elastomeric pad for this purpose will also be preferable in that it will tend to be more durable than a corresponding soft elastomeric pad.

Figure 1:
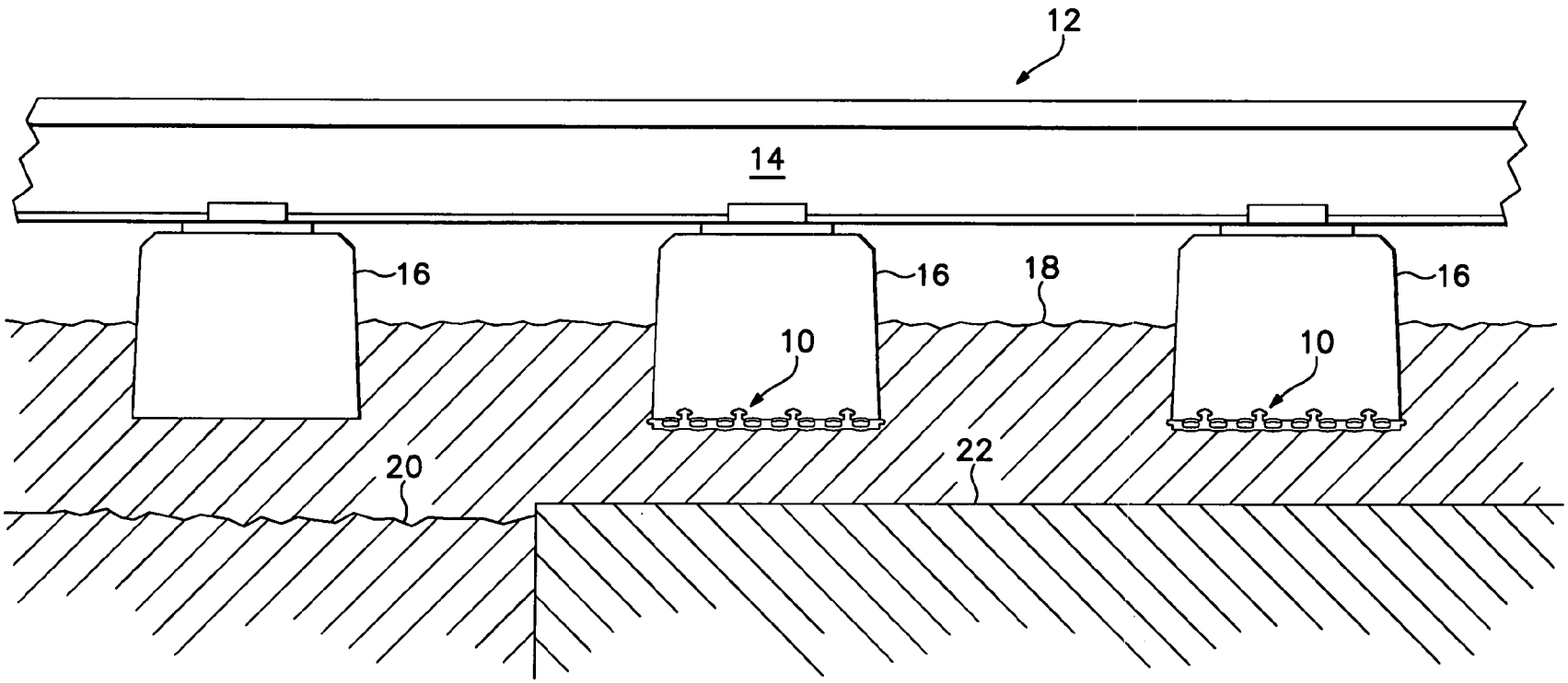
FIG. 1 shows a section of a railroad track laid over a bridge and an adjacent approach where the track on the bridge includes an elastomeric pad.

Referring to FIG. 1, an elastomeric pad 10 may be positioned within a railroad track 12, where the railroad track 12 also includes rails 14, a plurality of ties 16, and ballast 18. The elastomeric pad 10 may be placed between one or more ties 16 and the ballast 18. The railroad track 12 is shown as being laid over a transition from an approach 20 comprising a subgrade of natural ground to a structure 22 such as a bridge or tunnel having an underlayment of concrete, wood, or other more rigid material. The ties 16 may be of any desired material such as concrete, wood, or plastic for example. Though the exemplary track 12 includes ballast 18 positioned over the structure 22, other railroad tracks may exclude the ballast 18, with the pad 10 being inserted between the one or more ties 16 and the structure 22.

The modulus of the elastomeric pad 10 will preferably also be of a value that dampens vibrations of a passing rail car. This value will usually be such that the total track deflection is generally within the range of 3000 to 6500. The difference in the track deflection between the approach 20 and the structure 22 will typically be large enough that, uncorrected, a rail car passing onto or off the bridge will be subjected to a significant impact. Accordingly, the elastomeric pad 10 has a modulus that reduces the difference in track deflection and thereby reduces the attendant impact transmitted to a passing rail car.

The elastomeric pad 10 shown in FIG. 1 has unique features different from corresponding prior art pads. First, the modulus of the elastomeric pad 10 is preferably calculated, not merely to bring the total track deflection to within a desired range for vibrational dampening, but also to closely match the particular deflection of the surrounding approach. Second, unlike corresponding prior art pads, which are only designed for vibrational dampening, the elastomeric pad 10 may preferably be made of a material that has a durometer of at least about 65, or greater. An elastomeric pad having a high durometer helps ensure that the additional deflection provided by the pad does not diminish significantly over time. For example, the present inventors have discovered that respective pads 10 having durometers within the range of about 65 to about 75 have sufficient durability to provide the desired track deflection over a substantial duration. It also may be desirable in some circumstances to use a pad 10 having a durometer higher than 75. Though the pad 10 shown in FIG. 1 includes both of the aforementioned unique features, i.e., has a durometer over about 65 and a modulus calculated to equalize the deflection between the structure and the surrounding approach, various embodiments of the disclosed pad 10 may include only one of these features.

Figure 2:
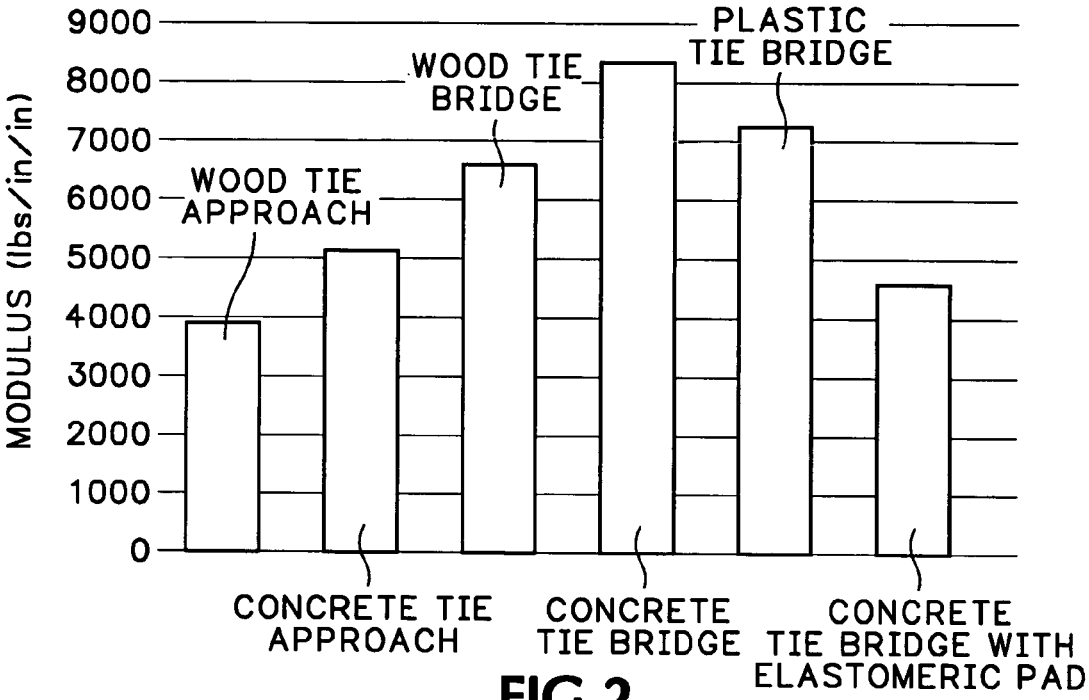
FIG. 2 shows the modulus provided by track laid over various surfaces.

Referring to FIG. 2, the use of the disclosed pad 10 may be used in conjunction with a variety of railroad track types and structures. For example, track over a concrete tie bridge, without the disclosed pad 10 would ordinarily have a modulus of over 8000, i.e., it would take more than 8000 pounds per linear inch of track to deflect that track an inch. The corresponding approach, however, has a modulus of around 5000—a difference that would ordinarily impart a substantial impact to a passing rail car. To correct this differential, a pad 10 may be positioned beneath the concrete ties on the bridge where the pad 10 has a modulus that reduces the total track modulus of the concrete tie bridge, preferably to between 5000 and 6000. Likewise, with a wood tie bridge and a wood tie approach, a corresponding pad 10 positioned beneath the wood ties on the bridge would preferably reduce the modulus of the track from about 6800 to somewhere between 3000 and 5000. It should be noted that although the problem to be corrected typically involves a track deflection on the structure that is too high in relation to the surrounding approach, care should be taken that the modified track modulus, with the pad 10, is not too low, as this also would create an undesirable impact or vibration. The particular values shown in FIG. 2 for the respective track modulus of the concrete and wood tie bridges and approaches are exemplary only, and may vary for each particular bridge and approach depending on the construction of the bridge and the type of surrounding terrain.

As stated previously, if the pad 10 is made of a relatively hard material, e.g., has a durometer greater than about 65, the pad 10 will not tend to stiffen much over time as it is used. However, though less so than corresponding softer pads, the pad 10 will likely stiffen slightly. Therefore, it may be desirable for the pad 10 to have a modulus calculated to bring the track modulus of the bridge or other structure to about 1000 less than the corresponding modulus of the approach. For example, if the pad 10 is used in combination with a concrete tie bridge, and using the exemplary values shown in FIG. 2, it may be desirable that the pad 10 initially bring the track modulus of the bridge down to about 4000. Over time, as the pad 10 stiffens slightly through use, the track modulus will gradually increase and level off at a value that more closely matches the modulus of the surrounding approach.

Figure 3:
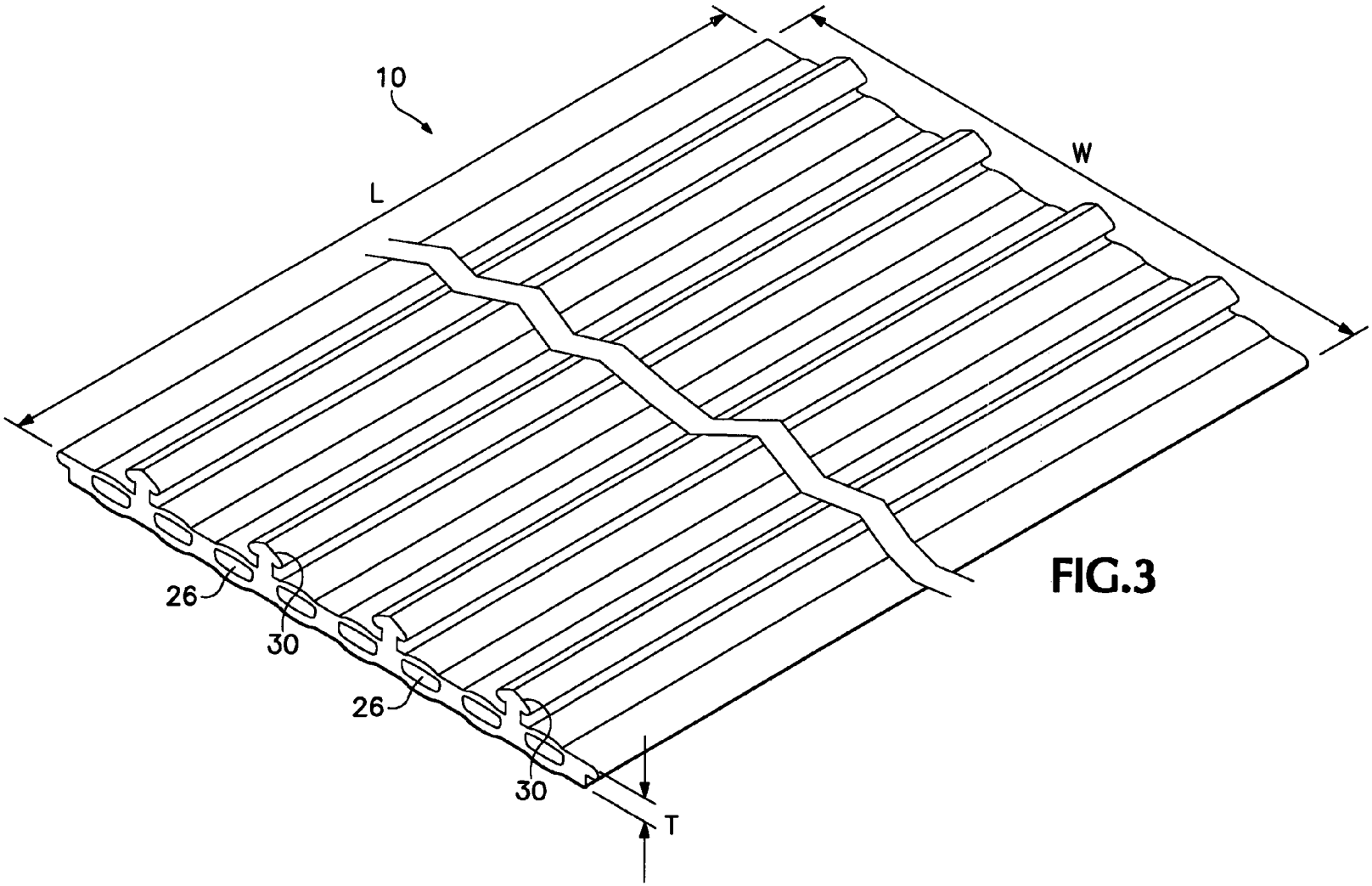
FIG. 3 shows a perspective view of the pad of FIG. 1.

Referring to FIG. 3, the hard material that provides the elastomeric pad 10 with its durability will also tend to resist vertical deflection. The desired deflection is therefore achieved by the selection of an appropriate shape factor for the pad 10. The term "shape factor" as used in this specification means the ratio of the cross-sectional area of the loaded faces to the cross-sectional areas of the faces free to expand laterally.

$$\text{Shape factor} = \text{loaded area}/\text{free area}$$

The shape factor of an elastomeric pad, along with methods to calculate its value, are well known and described in many textbooks such as *The Handbook of Molded and Extruded Rubber,* 2nd Ed., The Goodyear Tire and Rubber Co. (1959). A desired shape factor of the elastomeric pad 10 may be achieved by the appropriate design of the pad's thickness and the size and shape of a plurality of cavities 26 with which to provide the desired expansion. Each of the cavities 26, for example, may be bounded by a generally oval inwardly directed surface, the material of which is free to expand in a direction outwardly normal to the surface. A generally oval surface is advantageous in that it distributes stress. Other shapes of the cavities 26 may be selected as desired, however, such as rectangular or triangular.

Preferably, the pad 10 has a relatively small thickness, such as in the range of between about ⅜ of an inch to about ¾ of an inch. This small thickness serves two purposes.

First, given that the pad 10 will stiffen over time, albeit to a degree less than softer pads, the resulting loss of deflection is directly related to the thickness of the pad, i.e., the more material there is to stiffen, the greater the loss of deflection. Thus by minimizing the thickness of the pad, the loss of deflection through use is also minimized. Second, the pad 10 may be used in track laid through tunnels in which clearance is an issue. Because the thickness of the pad is preferably small, the contribution to the shape factor of the edges of the pad 10 may be both relatively small and relatively constant if a thin pad is used. Therefore, assuming that the design of a pad for a particular track over a structure calls for a particular shape factor, it is desirable to provide that shape factor by altering the size and shape of the cavities 26 rather than increasing the thickness of the pad 10.

The pad 10 is preferably designed to achieve a total track modulus in the track within which it is placed within a desired range, i.e., track over a bridge or other structure may be formed with an elastomeric pad 10 having elastomeric properties such that the total track modulus over the structure approximates the total track modulus of the approach to the structure to within a desired variance. Because the type of terrain over which track is laid varies considerably, the elastomeric properties of the pad 10, such as the pad's thickness, the number of cavities 26, and the shape and size of the cavities 26 will also vary considerably, largely depending upon the particular terrain within which the structure is located as well as the construction of the structure itself, i.e., concrete, wood, etc.

A preferred method for designing an appropriate pad 10 for use in track over a particular structure is to first determine the total track modulus of the track over the structure without the pad 10 as well as the total track modulus of the approach, the difference being the desired modulus of the pad 10. The total track modulus of the structure and the approach, respectively, may be approximated by tables or industry data, or more preferably, may be actually measured.

Figure 3A:
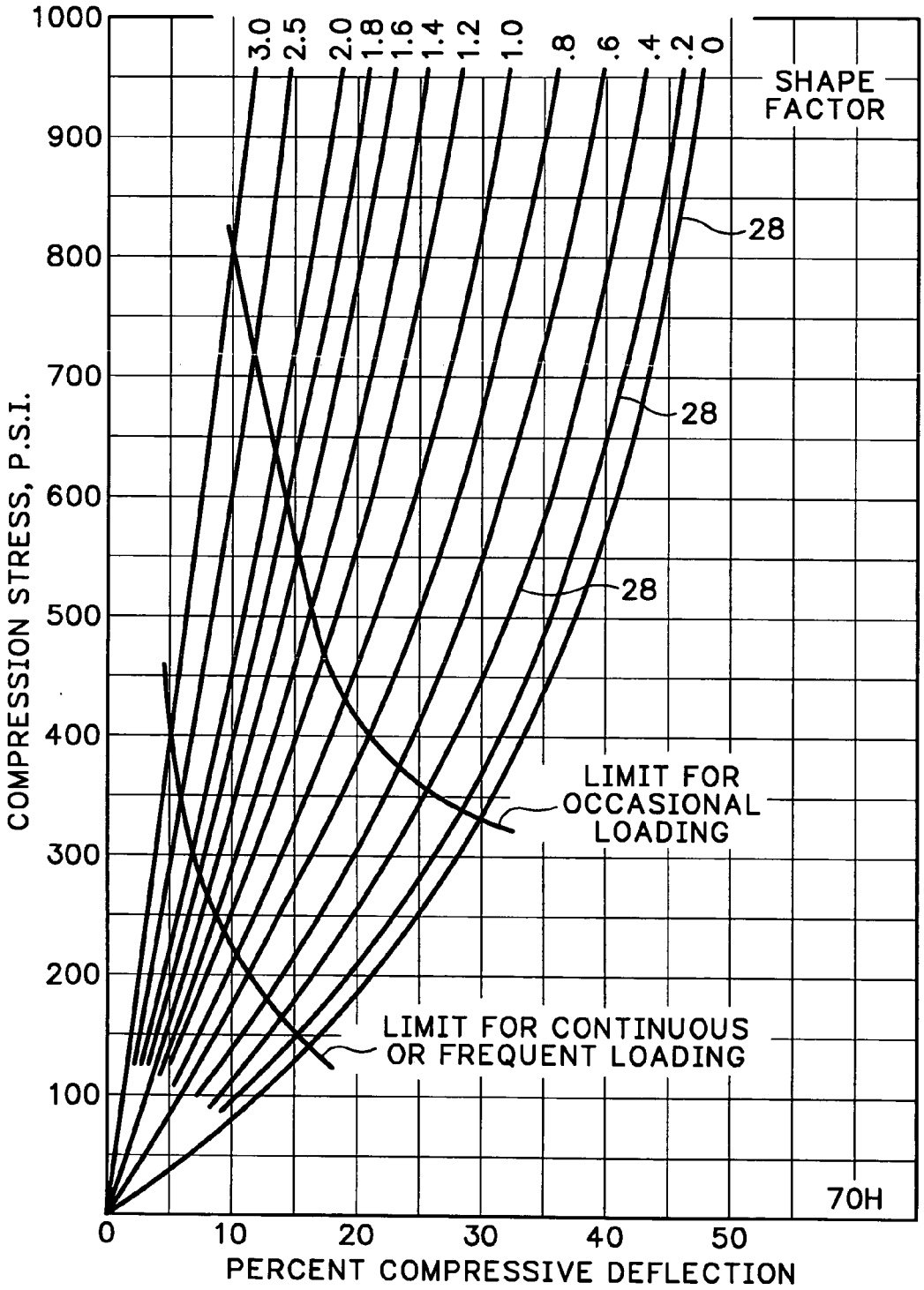
FIG. 3A shows an exemplary stress-strain chart for pads of various durometers.

Once a desired modulus of the pad 10 is calculated, a stress-strain chart such as the one shown in FIG. 3A may be used to determine an initial shape factor for the pad 10. The stress-strain chart shown in FIG. 3A is for an elastomeric pad of a chosen durometer and shows the respective modulus (the slopes of the lines 28) for each of a plurality of shape factors. Once the initial shape factor is determined, a pad may be fabricated and tested on the applicable structure to determine whether the pad 10 achieves the desired total track modulus. If not, a second shape factor may be calculated based on the tested total track modulus and a pad 10 fabricated based on the second shape factor. This iterative process may be repeated until the desired total track modulus is achieved to within a desired range of accuracy, such as 2000, 1500, 1000, or 500.

Figure 4A:
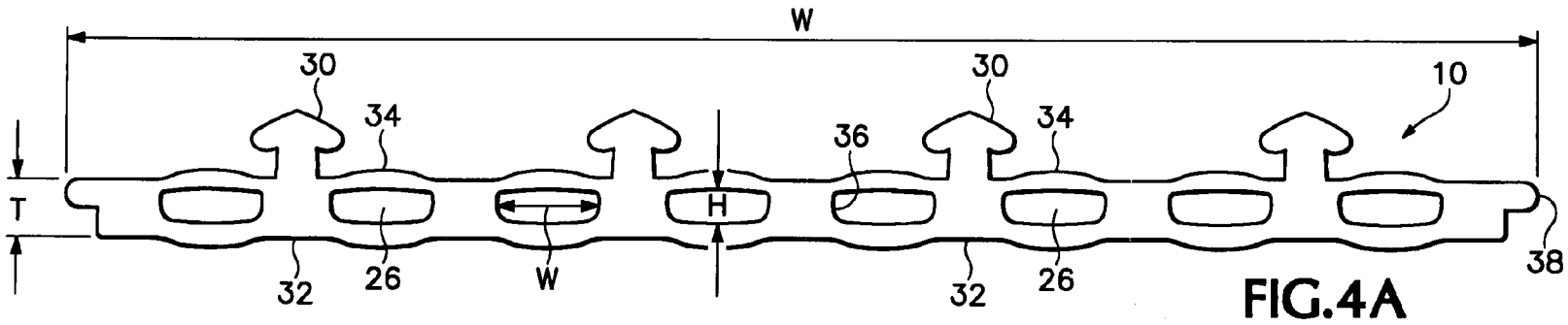
FIG. 4 shows sections of several embodiments of the pad of FIG. 1.
Figure 4B:
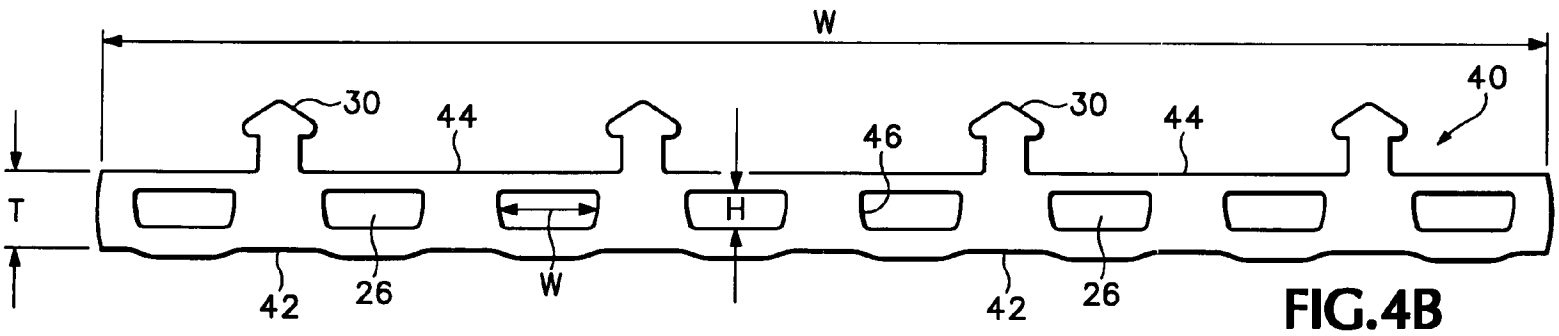
Figure 4C:
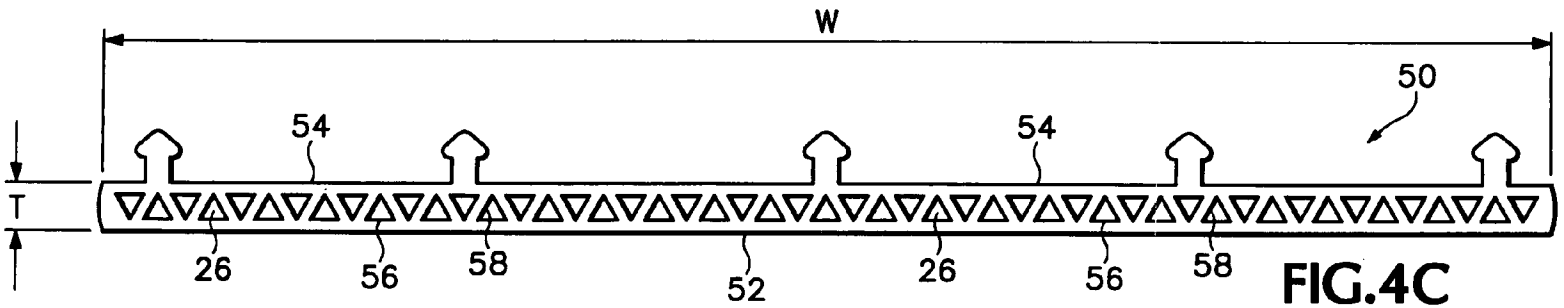

Referring to FIGS. 4A-4C, three exemplary pads 10 are shown, each designed to achieve a different track modulus as appropriate. FIG. 4*a* shows a preferred embodiment of the pad 10 that has a width of about 10.5 inches, which is the width of a concrete tie. Where the pad 10 is intended for use with wooden or other type ties having different dimensions than a concrete tie, the width may vary accordingly. The pad 10 has a length (into the page) of approximately 8.5 feet, which also corresponds to the standard length of a concrete tie. The pad 10 has a thickness t of 0.5 inches, measured from the lower surface 32 to the upper surface 34.

The pad 10 shown in FIG. 4*a* includes eight cavities 26, each of a generally rectangular shape, but having rounded edges. The rounded edges provide increased durability over squared edges, which would tend to fissure through repeated use. The approximate width "w" of each cavity 26 is 0.75 inches and the approximate height "h" of each cavity is 0.25 inches. With these dimensions, the shape factor of the pad 10, as defined above is approximately 1.16.

The pad 10 may include plural protruding portions 30 that facilitate the attachment of the pad 10 to the concrete tie. The protruding portion or portions 30 may be generally arrow shaped, as seen in FIGS. 3 and 4, or alternatively, may be mushroom-shaped or have any other desired shape. The pad 10 may be secured to a concrete tie as the tie is cast in a mold by positioning the pad 10 over the tie such that the protruding portions 30 are face down into the tie before the tie solidifies in the mold. The pad 10 as seen in FIG. 4*a* is also shown as having lateral wing portions 38 that assist in holding the pad 10 in place over the mold that casts the concrete ties. The lateral wing portions 38 are configured such that they rest on the edges of the mold when the pad is placed upside down over the mold so that the protruding portions 30 are held within the concrete while it hardens.

The pad 40 shown in FIG. 4*b* shows a second exemplary pad 40 that also has a width of about 10.5 inches and has a length (into the page) of approximately 8.5 feet, which also corresponds to the standard length of a concrete tie. The pad 40 has a thickness t of 0.75 inches, measured from the lower surface 42 to the upper surface 44. The pad 40 includes eight cavities 26, each of a generally rectangular shape, but having rounded edges that provide increased durability over squared edges, which would tend to fissure through repeated use. The approximate width "w" of each cavity 26 is 0.75 inches and the approximate height "h" of each cavity is 0.375 inches. With these dimensions, the shape factor of the pad 40, as defined above is approximately 0.57.

FIG. 4*c* shows a third exemplary pad 50 that also has a width of about 10.5 inches and a length (into the page) of approximately 8.5 feet, which also corresponds to the standard length of a concrete tie. The pad 50 has a thickness t of 0.375 inches, measured from the lower surface 52 to the upper surface 54. The pad 50 includes 51 cavities 26, each of a generally isosceles triangular shape where each side 56 of each triangle measures approximately 0.188 inches. Because of the triangular cross section of the cavities 26, however, the shape factor of the pad 50 may not be easily calculated because it cannot be determined whether the inner, sloped surfaces of the cavities 26 will expand outward in response to an applied load or will instead bow inward.

The elastomeric properties of the pads 10, 40, and 50 are primarily determined by three variables in addition to the material of the respective pads. First is the Shore A hardness of the material; the harder the material the less resilient the respective pad will be. Second is the shape factor of the pad; the lower the shape factor, the more resilient the respective pad will be. Third is the thickness of the material; the thicker the material, the more resilient the respective pad will be. One advantage of the pads 10, 40, and 50 is that the relatively low shape factor (i.e., a large expandable area in proportion to the load area) permits the pads 10, 40, and 50 to have a relatively small thickness, which is advantageous in that the respective pads are less likely to affect the clearance of tunnels and are more durable. Thus the respective shape factors of the pads 10, 40, and 50 permit the pads to have a thickness of less than about an inch, and preferably within the range of about 0.25 inches to 0.75 inches.

Figure 5:
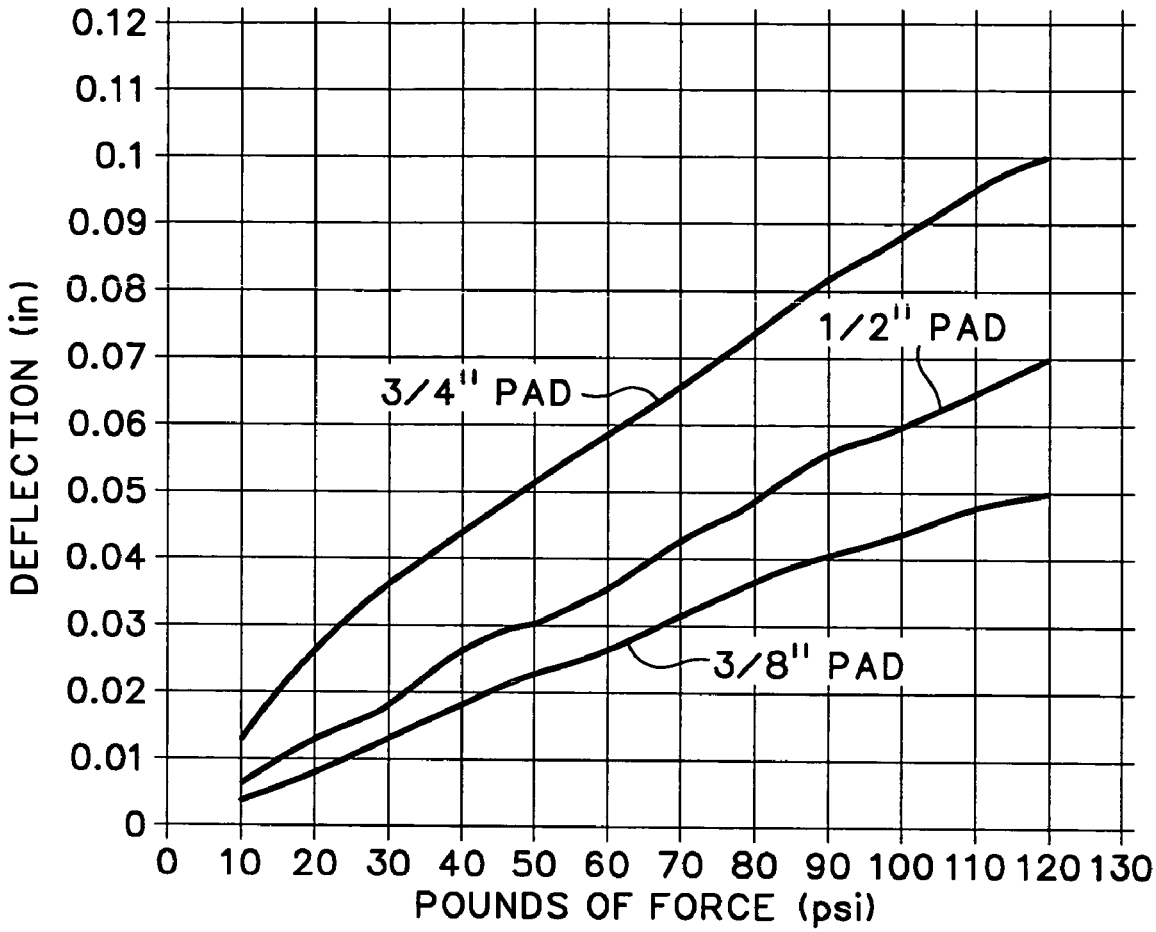
FIG. 5 shows the deflection characteristics of each of the pad embodiments shown in FIG. 3

The pads 10, 40 and 50 shown in FIGS. 4*a*-4*c* are preferably made of elastomeric material, which may be rubber, either natural or synthetic, or any other elastomeric material. Preferably, the elastomeric material used has a durometer higher than 65. The pads 10, 40, and 50 are each made of rubber having a durometer of approximately 75. FIG. 5 shows the performance characteristics of each of the pads 10, 40, and 50. As can be seen from this figure, the preferred pad 10, which has a thickness of 0.5 inches, has a deflection of approximately 0.09 inches when subjected to 100 pounds of pressure per square inch. The pad 40, which has a thickness of 0.75 inches, has a deflection of approximately 0.06 inches when subjected to 100 pounds of pressure per square inch. The pad 50, which has a thickness of 0.375 inches, has a deflection of approximately 0.043 inches when subjected to 100 pounds of pressure per square inch.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only the claims that follow.

The invention claimed is:

1. In combination with a section of railroad track comprising rails, a railroad tie having a lower surface and a supporting rail bed having an upper surface: a single elastomeric tie pad for providing vertical cushioning, said tie pad located between said tie and said rail bed and having an upper pad surface adjacent said lower surface of said tie and a lower pad surface adjacent said upper surface of said rail bed, said tie pad having a durometer of at least 65 and defining at least two cavities between said upper pad surface and said lower pad surface into which the material of said tie pad may expand when said pad is compressed, said tie pad including two or more protrusions extending upwardly from the upper pad surface through said lower surface of said tie and into said tie.

2. The combination of claim 1 wherein at least one of said protrusions is positioned above one of said cavities.

3. The combination of claim 1 wherein none of said cavities are positioned directly below at least one of said protrusions.

4. In combination with a section of railroad track comprising rails, a railroad tie having a lower surface and a supporting rail bed having an upper surface: a single elastomeric tie pad for providing vertical cushioning, said tie pad located between said tie and said rail bed and having an upper pad surface adjacent said lower surface of said tie and a lower pad surface adjacent said upper surface of said rail bed, said tie pad having a thickness of less than about ¾ inch and including at least two cavities between said upper pad surface and said lower pad surface into which the material of said tie pad may expand when said pad is compressed, said tie pad including two or more protrusions extending upwardly from said upper pad surface through said lower surface of said tie and into said tie.

5. The combination of claim 4 wherein at least one of said protrusions is located above at least one of said cavities.

6. The combination of claim 4 wherein none of said cavities are located directly below at least one of said protrusions.

7. In combination with a section of railroad track comprising rails, a railroad tie having a lower surface and a supporting rail bed having an upper surface: a single elastomeric tie pad for providing vertical cushioning, said tie pad located between said tie and said rail bed and having an upper pad surface adjacent said lower surface of said tie and a lower pad surface adjacent said upper surface of said rail bed, said tie pad defining at least two cavities between said upper pad surface and said lower pad surface into which the material of said tie pad may expand when said pad is compressed, said tie pad including two or more protrusions extending upwardly from said upper pad surface through said lower surface of said tie and into said tie.

* * * * *